US010828752B2

(12) United States Patent
Kroll

(10) Patent No.: US 10,828,752 B2
(45) Date of Patent: Nov. 10, 2020

(54) TOOL FOR INSTALLING AND REMOVING THREADED MEMBERS

(71) Applicant: Peter Kroll, Hockley, TX (US)

(72) Inventor: Peter Kroll, Hockley, TX (US)

( * ) Notice: Subject to any disclaimer, the term of this patent is extended or adjusted under 35 U.S.C. 154(b) by 67 days.

(21) Appl. No.: 14/423,301

(22) PCT Filed: Aug. 23, 2013

(86) PCT No.: PCT/US2013/056415
§ 371 (c)(1),
(2) Date: Feb. 23, 2015

(87) PCT Pub. No.: WO2014/031969
PCT Pub. Date: Feb. 27, 2014

(65) Prior Publication Data

US 2015/0209940 A1 Jul. 30, 2015

Related U.S. Application Data

(60) Provisional application No. 61/692,479, filed on Aug. 23, 2012.

(51) Int. Cl.
*B25B 13/50* (2006.01)
*B25B 13/32* (2006.01)
*B25B 13/18* (2006.01)

(52) U.S. Cl.
CPC ..... *B25B 13/5075* (2013.01); *B25B 13/18* (2013.01); *B25B 13/32* (2013.01); *B25B 13/5008* (2013.01)

(58) Field of Classification Search
CPC . B25B 13/5075; B25B 13/5083; B25B 13/54; B25B 13/505; B25B 13/32; B25B 13/04; B25B 13/5016
See application file for complete search history.

(56) References Cited

U.S. PATENT DOCUMENTS 715,900 A * 12/1902 Thompson ..... B23B 33/00 82/167
1,371,642 A * 3/1921 Olson ..... B25B 13/5083 279/102
1,400,930 A * 12/1921 Astley ..... B25B 13/54 81/443
1,471,367 A * 10/1923 Thrift ..... B25B 13/5075 279/77

(Continued)

FOREIGN PATENT DOCUMENTS

CA 1165544 4/1984
CA 2302112 1/2001

*Primary Examiner* — Bryan R Muller
(74) *Attorney, Agent, or Firm* — Bushman Werner, P.C.

(57) ABSTRACT

A tool for installing or removing a threaded member as for example a thread protector onto a second threaded member, as for example, the pin or box of an oilfield tubular, which has a jaw for selectively gripping an outer surface of a thread protector, a bridge interconnecting the jaw and a cam, the cam being selectively engageable with the inner surface of the thread protector, the cam being operatively connected to a lever for moving the cam from a first position out of contact with the inner surface of the thread protector to a second position in gripping engagement with the inner surface of the thread protector.

16 Claims, 3 Drawing Sheets

(56) References Cited

U.S. PATENT DOCUMENTS

| | | | | | |
|---|---|---|---|---|---|
| 1,516,602 | A * | 6/1928 | Stone | B25B 13/5075 | 279/77 |
| 1,675,064 | A * | 6/1928 | Stone | B25B 13/5075 | 81/53.2 |
| 1,682,097 | A * | 8/1928 | Shefveland | B25B 13/5075 | 81/53.2 |
| 1,815,363 | A * | 7/1931 | Proctor | B25B 13/5075 | 81/186 |
| 3,471,160 | A | 10/1969 | Sabo | | |
| 4,485,702 | A * | 12/1984 | Swan | B25B 13/481 | 81/177.2 |
| 4,676,125 | A * | 6/1987 | Ardelean | B25B 13/10 | 81/53.2 |
| 5,451,084 | A * | 9/1995 | Jansch | B25B 1/241 | 166/77.53 |
| 5,485,770 | A * | 1/1996 | Popelak | B25B 7/02 | 81/423 |
| 6,341,543 | B1 * | 1/2002 | Hsieh | B25B 13/463 | 81/63.2 |
| 7,024,972 | B2 * | 4/2006 | Werner | B25B 13/48 | 81/442 |
| 7,278,340 | B2 * | 10/2007 | Furnish | B25B 13/5008 | 81/92 |
| 7,600,450 | B2 * | 10/2009 | Montgomery | E21B 19/07 | 175/423 |
| 2011/0126677 | A1 | 6/2011 | Buchanan | | |

* cited by examiner

TOOL FOR INSTALLING AND REMOVING THREADED MEMBERS

CROSS REFERENCE TO RELATED APPLICATION

This application is a national phase of PCT/US13/56415, filed Aug. 23, 2013, which in turn claims priority to U.S. Application No. 61/692,479 filed on Aug. 23, 2012, the disclosures of which are incorporated herein by reference for all purposes.

FIELD OF THE INVENTION

The present invention relates to a tool for installing or removing threaded members and, more particularly, to a tool for installing or removing a thread protector onto or from a threaded piece of pipe or other equipment.

BACKGROUND OF THE INVENTION

Oilfield tubulars, e.g., tubing, casing, drill pipe, etc., have threaded ends, either male (pin) or female (box), as is well known to those skilled in the art. Because the threads of the tubular member are the most critical feature of a threaded connection, it is important they not be damaged during storage and/or transportation. To this end, so called thread protectors made of hard rubber, plastics, etc. have been developed. The thread protectors are designed to fit either a threaded pin or threaded box.

It will be appreciated that because the thread protectors are designed to fit specific threads, and must be rugged, they are expensive, i.e., the thread protectors are not disposable items. Accordingly, it is highly desirable, as well as cost-effective, to ensure that when the thread protectors are either installed or removed, they are not damaged.

Presently, the most common way of installing and removing thread protectors is by the use of a pipe wrench or similar tool. It will be appreciated that because the thread protectors, as noted above, are made of plastic, hard rubber, etc., a tool such as a pipe wrench can and inevitably does damage the thread protector, eventually rendering it unsuitable for use.

SUMMARY OF THE INVENTION

In one aspect, the present invention provides a tool for installing and/or removing a threaded cap onto or from a threaded member.

In another aspect, the present invention provides a tool for installing and/or removing a thread protector onto or from a threaded tubular such as tubing, casing and other tubulars used in the drilling, completion, and production of oil and gas wells.

In still a further aspect, the present invention provides a tool for installing and/or removing a thread protector which is easily adaptable to various sized thread protectors.

In another aspect, the present invention provides a tool fro installing and/or removing a thread protector onto or from a pin connection or a box connection.

These and further features and advantages of the present invention will become apparent from the following detailed description, wherein reference is made to the figures in the accompanying drawings.

DETAILED DESCRIPTION OF PREFERRED EMBODIMENTS

While the present invention will be described with respect to a tool for installing or removing thread protectors onto or from a threaded tubular connection, particularly threaded tubular connections used in the oil and gas industry, it will be understood that the invention is not so limited. It is equally applicable to installing thread protectors on other threaded components, e.g., wellhead assemblies and the like. Furthermore, the tool of the present invention can be used for installing any type of threaded cap, or more generally a threaded, annular member into or on a receiving member.

Figure 1:
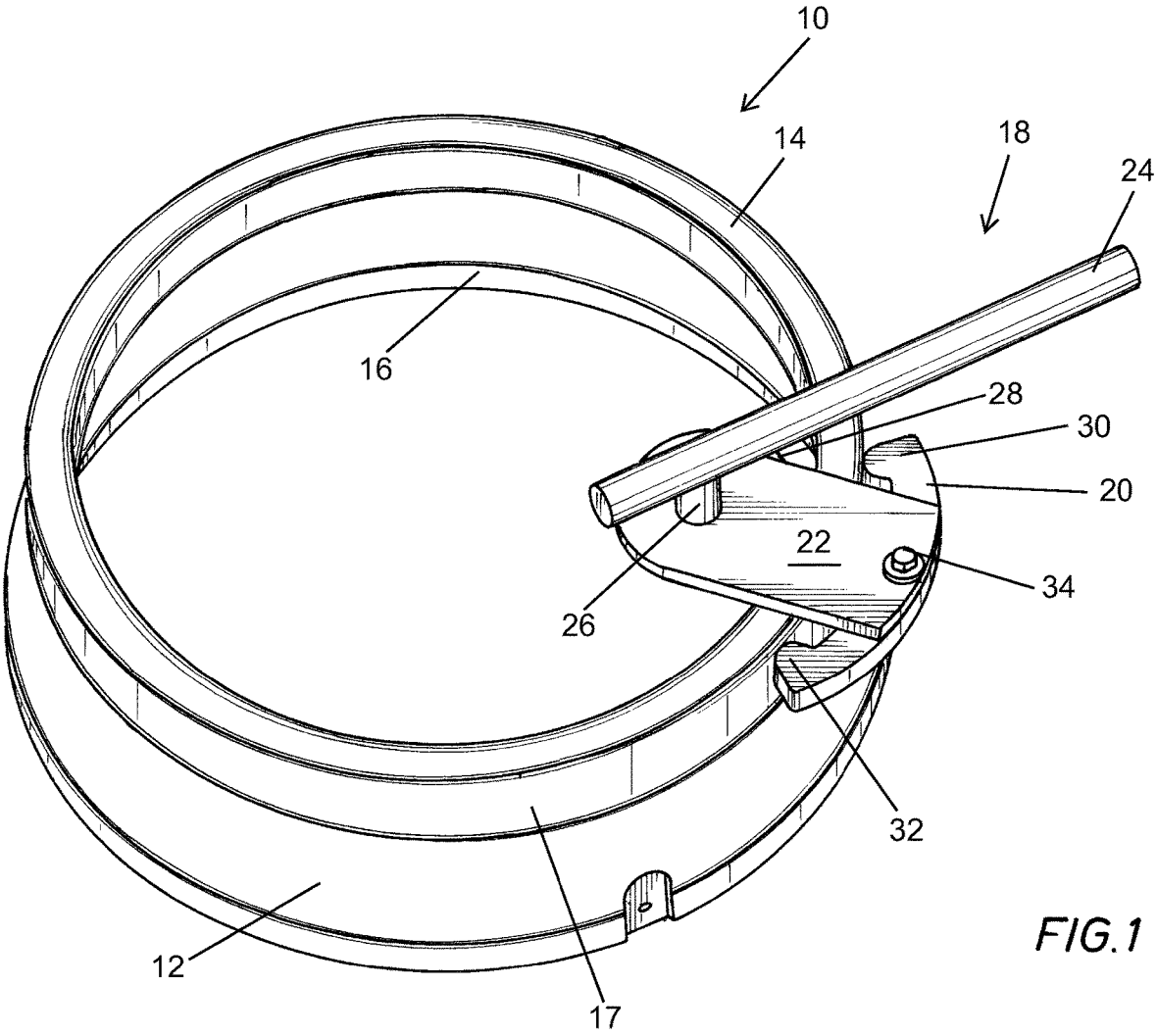
FIG. 1 is an isometric view showing the tool of the present invention ready for use with a thread protector used for protecting threads on a pin member.

Referring then to FIG. 1, there is shown one embodiment of the tool of the present invention mounted on a thread protector having internal or box threads for protecting the threads, e.g., of a pin having external male threads. The thread protector shown generally as 10 is a generally cylindrical body 12 having a lip or rim 14 with an annular, internal cylindrical surface 15 and an annular external cylindrical surface 17, the internal surface of body 12 being provided with box threads 16. As is typical of virtually all thread protectors, the rim or lip 14 of thread protector 10 forms an annular shoulder 19 (see FIG. 3). Accordingly, when the thread protector 10 is being installed on a member having male or pin threads, the shoulder 19 formed on lip or rim 14 acts as a stop.

One embodiment of the tool of the present invention is shown generally as 18 in FIG. 1. Tool 18 comprises an outer jaw 20 which is connected to a bridge 22. A shaft 26 connects a lever 24 with a cam 28, only a small portion of which is shown in FIG. 1. Shaft 26 is rotatably mounted in bridge 22 but, as seen hereafter, is fixedly connected to cam 28 as well as lever 24. Jaw 20, which is a generally arcuate-shaped member, has inwardly projecting gripping portions 30 and 32, jaw 20 being pivotally connected to bridge 22 by a nut and bolt assembly 34.

Figure 3:
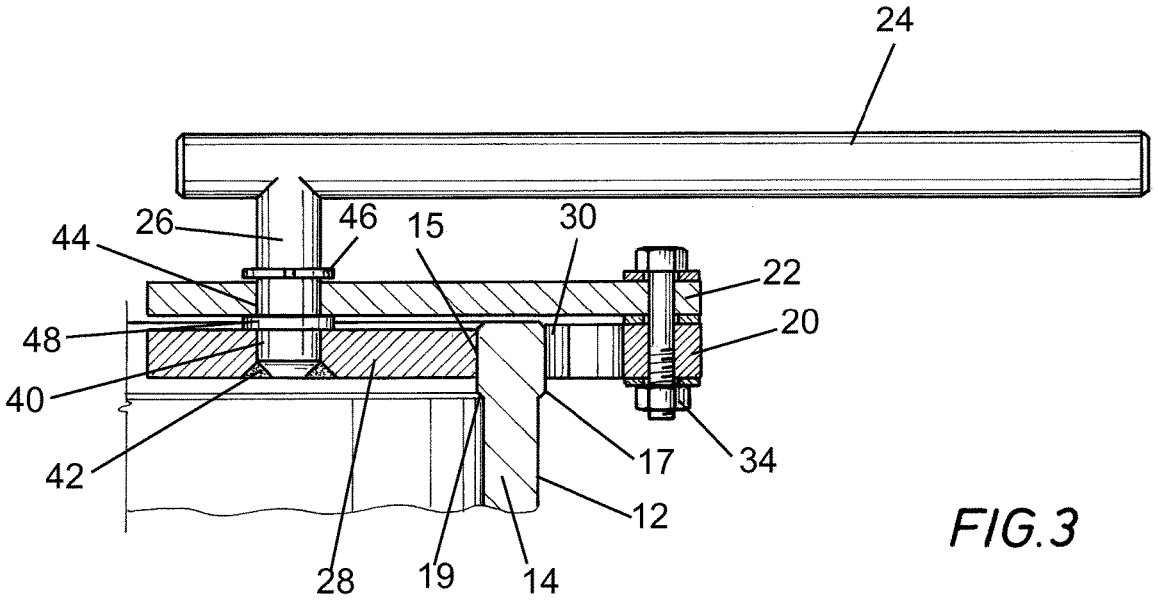
FIG. 3 is an elevational view, partly in section, taken along the lines 3-3 of FIG. 2.

Referring now to FIG. 3, it can be seen that shaft 26 is fixedly connected to lever 24, e.g., by welding, and is received in a opening 40 in cam 28, shaft 26 being secured to cam 28 by welding 42. Shaft 26 extends through a hole 44 in bridge 22 whereby shaft 26 can rotate with respect to bridge 22. Shaft 26 has an annular groove for receipt of a snap ring 46. A washer or spacer 48 is received over shaft 26 and spaces cam 28 from bridge 22.

Figure 2:
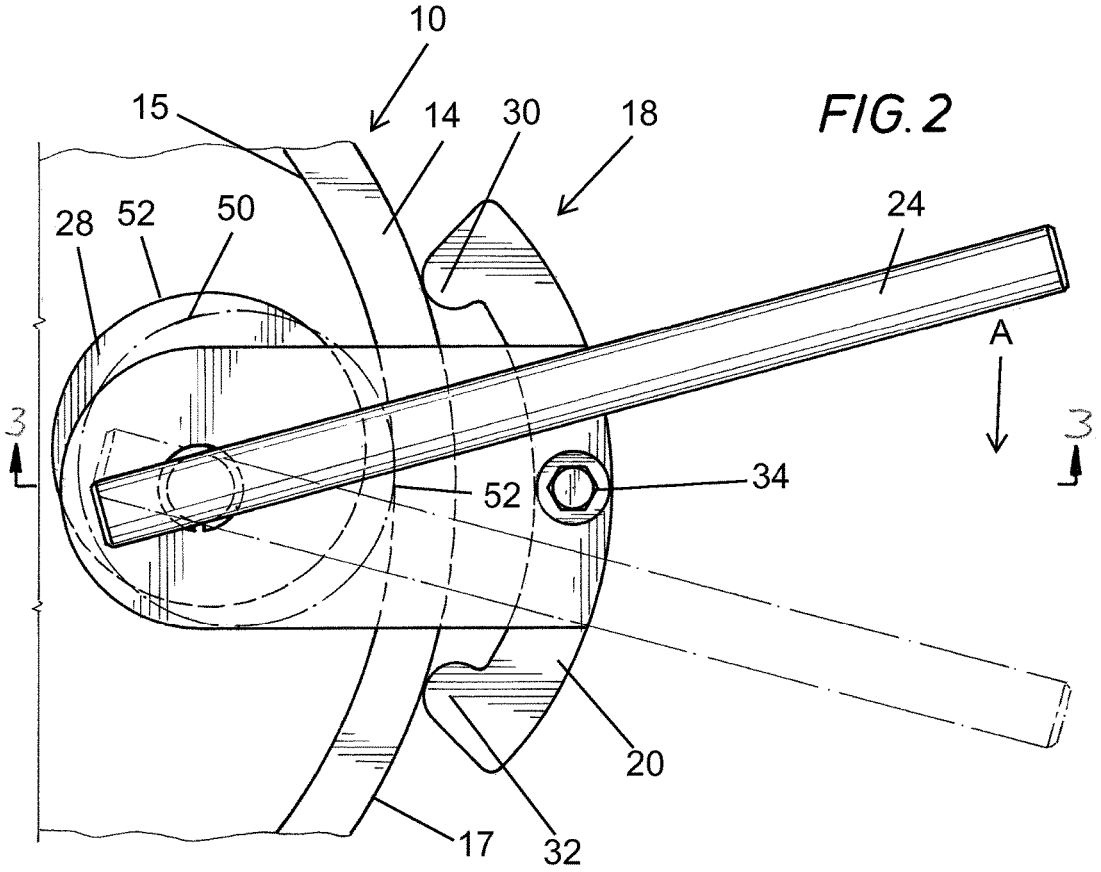
FIG. 2 is a plan view of the tool shown in FIG. 1, showing how the tool is engaged with the thread protector.

Referring now to FIG. 2, the operation of tool 18 will be described. Tool 18 is initially positioned over rim 14 of thread protector 10 in the position shown in full lines in FIG. 2. As can best be seen with reference to FIG. 2, cam 28 is a circular disc and shaft 26 is secured to cam 28 at a position eccentric to the center of the disc. Accordingly, there is effectively formed a camming lobe 50 on cam 28 having a camming surface 52. In the position shown in FIG. 2, it can be seen that there is a clearance between the outer edge of cam 28 and the inner surface 15 of thread protector 10.

As lever 24 is now moved in the direction of arrow A, camming surface 52 rotates, also in the direction of arrow A, until it engages the inner surface 15 of rim 14. Further, since jaw 20 is pivotally secured to bridge 22, gripping projections 30 and 32 adjust to grippingly engage the outer surface 17 of thread protector rim 14. As will be appreciated any further movement of lever 24 in the direction of arrow A increases the engagement between gripping portions 30 and 32 with outer surface 17 and camming surface 52 with the inner surface 15 of rim 14 of thread protector 10. Once camming surface 52 and gripping portions 30 and 32 are tightly engaged with the rim 14 of thread protector 10, lever 24 can then be further rotated in the direction of arrow A which in turn rotates thread protector 10 causing the female threads 16 to screw onto the male threads of the pin or male member to be protected.

Figure 4:
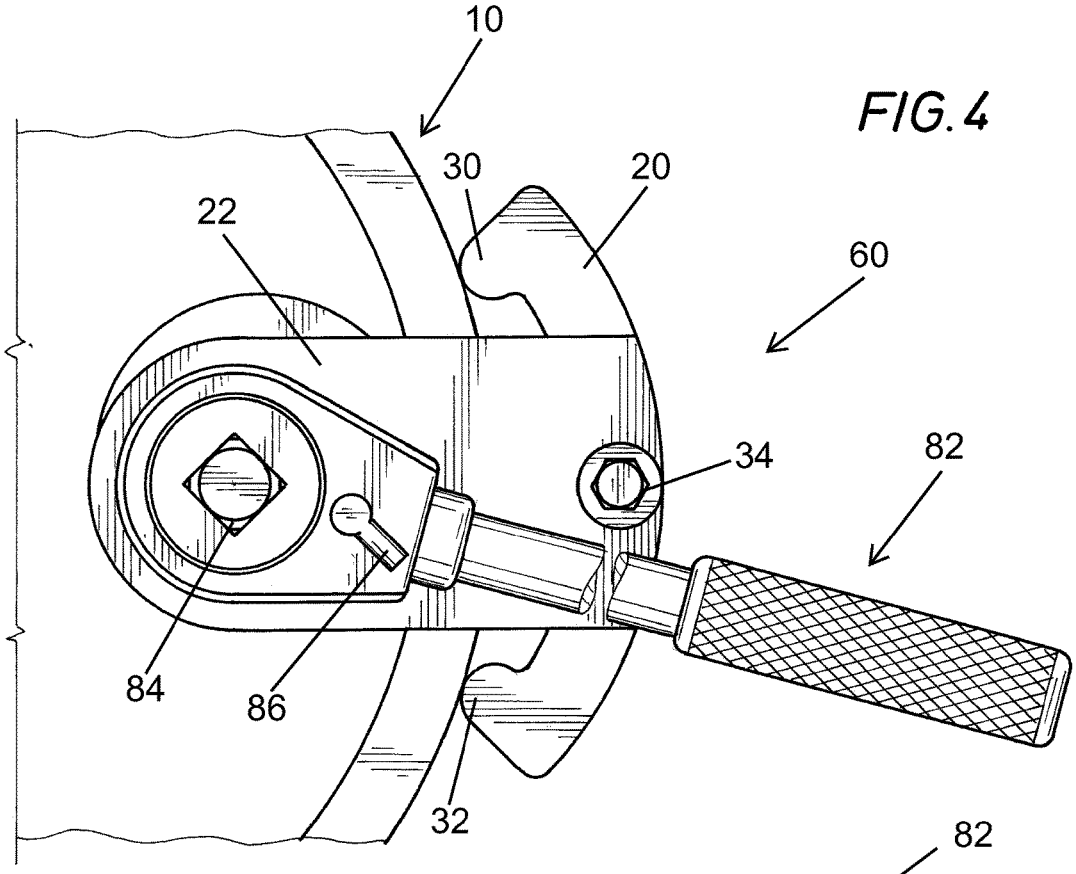
FIG. 4 is a plan view of another version of the tool of the present invention shown attached to a thread protector.
Figure 5:
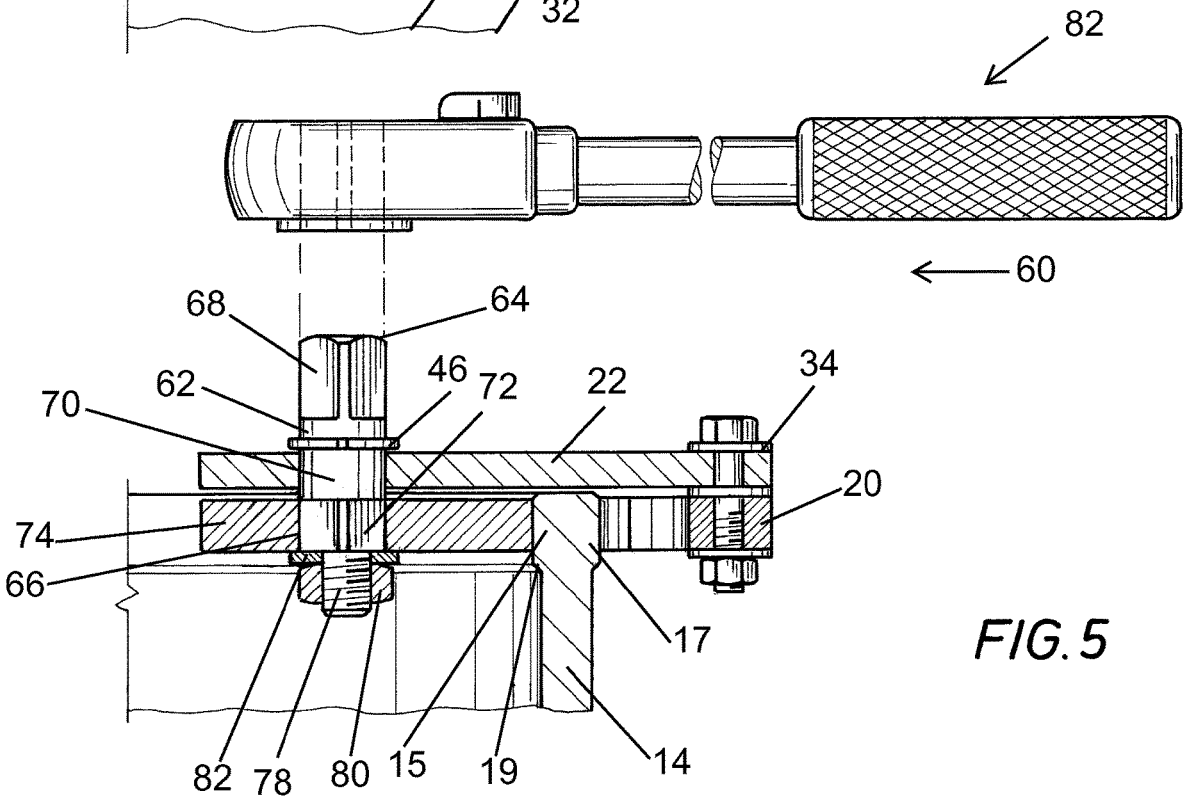
FIG. 5 is a side, elevational view, partly in section, of the tool shown in FIG. 4.

Referring now to FIGS. 4 and 5, there is shown another embodiment of the tool of the present invention. The tool, shown generally as 60, is very similar to the tool described above and shown in FIGS. 1-3 and accordingly like parts have like reference characters in the figures. The primary difference between the tool shown in FIGS. 1-3 and the tool shown in FIGS. 4 and 5 is the fact that the lever of the tool 60 in FIGS. 4 and 5 is selectively, removably connected to the shaft. Additionally, the connection of the shaft to the cam disc is such that the shaft can be removed unlike the embodiment shown in FIG. 3, wherein the shaft is secured to the cam by welding.

Shaft 62 has a first end 64 and a second end 66. First end 64 is provided with a series of wrench flats 68 which, as shown, form a square cross-section but which can be hexagonal or have any desired number of facets. Shaft 62 has a central portion 70 which is circular when viewed in transverse cross-section, portion 70 being received in a circular, complementary opening in bridge 22. Second end 66 of shaft 62 also is provided with a series of wrench flats 72, first end 66 being received in an opening in disc or cam 74 which has a complementary shape, i.e., in the case shown, square. Accordingly, shaft 62 is keyed to cam 44 albeit removably, unlike the embodiment shown in FIGS. 1-3. Shaft 62 is also provided with a threaded shank 78 extending from the second end 66 of shaft 62 whereby shaft 62 can be secured to cam 74 by means of a nut 80 and a washer 82. Thus, unlike the embodiment shown in FIGS. 1-3, in the embodiment of the tool shown in FIGS. 4 and 5, the bridge 22, the shaft 62, and the cam or disc 74 can easily be separated for replacement, if necessary.

As noted above, first end 64 of shaft 62 is provided with a series of wrench flats 68. A ratchet 82 has a socket 84 which is complementary in cross-sectional shape to the square cross-section formed by wrench flats 68 on first end 64 of shaft 62. Thus, in a well known manner, once shaft 62 is received in ratchet socket 84, and detent 86 is in the proper position, ratchet 82 can be moved in ratchet-like movement to force cam or disc 74 against the inner surface 15 of rim 14 of thread protector 10, it being understood that the gripping formations 30 and 32 are likewise forced against the outer surface 17 of rim 14. Once there is tight engagement with the gripping formations 30 and 32 with outer surface 17 and the camming surface on cam 74 with inner surface 15, the ratchet can then be used as a lever to thread the thread protector 10 onto an appropriate threaded member having a pin connection. It will be appreciated that the connection between shaft 62 and cam 74 is eccentric to the center of cam 74, cam 74 being generally circular. It will be apparent that other shapes of cams, plates, or discs can be used. For example cam mechanisms which have a cam which has a generally tear-drop shaped configuration are well known.

It will also be appreciated that the connection between the disc 74 and shaft 62 could be by welding such as shown in the embodiments of FIGS. 1-3 if desired. Likewise, the connection of the shaft 26 and cam 28 in the embodiment of the tool shown in FIGS. 1-3 could be a keying method as shown with respect to the embodiment 60 shown in FIGS. 4 and 5.

While the tool of the present invention has been described with respect to its use with a thread protector for protecting the pin threads of a tubular member, it will be understood that it can also be used with thread protectors for protecting the female or box threads of tubular members. In this regard, and as well known to those skilled in the art, thread protectors whether used for pin threads or box threads are provided with a rim, lip or the like, which can be gripped by the tool of the present invention. Typical examples of thread protectors for either pins or boxes are shown in U.S. Pat. No. 4,442,737, incorporated herein by reference for all purposes.

Although specific embodiments of the invention have been described herein in some detail, this has been done solely for the purposes of explaining the various aspects of the invention, and is not intended to limit the scope of the invention as defined in the claims which follow. Those skilled in the art will understand that the embodiment shown and described is exemplary, and various other substitutions, alterations and modifications, including but not limited to those design alternatives specifically discussed herein, may be made in the practice of the invention without departing from its scope.

What is claimed is:

1. A tool for installing or removing a first threaded member from a second threaded member, comprising:

a bridge having an upper surface, a lower surface, a first end and a second end;

a jaw having an arcuate jaw body, said jaw pivotally connected to said bridge by a pivot assembly, said pivot assembly comprising an elongate member extending through said upper and lower surfaces of said bridge and said jaw such that said jaw pivots in a circumferential direction around the long axis of said elongate member, said elongate member being selectively removable from said bridge and said jaw;

a cam rotatably connected to said bridge, distally spaced from said jaw, said cam having a laterally outwardly projecting camming surface; and a lever, operatively connected to said cam, movement of said lever in a first direction causing movement of said cam in a first direction which decreases the distance between said jaw and said camming surface, said bridge being disposed between said cam and said lever, said arcuate iaw body having a first lateral surface facing away from said cam and a second lateral surface facing toward said cam, said second lateral surface being concave.

2. The tool of claim 1, wherein there is a shaft having a first end and a second end, said first end being connected to said lever, said second end being connected to said cam.

3. The tool of claim 2, wherein said lever is fixedly connected to said shaft and movement of said cam in a second direction causes an increase in the distance between said jaw and said camming surface.

4. The tool of claim 1, wherein said jaw has first and second, spaced gripping portions extending from said second lateral surface of said jaw in a direction toward said second end of said bridge, the laterally outermost surfaces of said gripping portions lying on an arc.

5. The tool of claim 4, wherein said pivot assembly comprises a nut and bolt assembly and wherein said elongate member is said bolt.

6. The tool of claim 1, wherein said cam comprises a generally circular disc.

7. The tool of claim 2, wherein said cam comprises a generally circular disc.

8. The tool of claim 7, wherein said second end of said shaft is connected to said disc at a position eccentric to the center of said disc.

9. The tool of claim 7, wherein said first end of said shaft has wrench flats and said lever is selectively, removably connected to said shaft.

10. The tool of claim 9, wherein said second end of said shaft has wrench flats and said disc has an opening complementary to the cross-sectional shape of said second end of said shaft.

11. The tool of claim 9, wherein said lever comprises a ratchet.

12. The tool of claim 11, wherein said wrench flats on said first end of said shaft are on the outer surface of said shaft and said ratchet has a socket with a cross-sectional shape complementary to the cross-sectional shape of said first end of said shaft.

13. The tool of claim 4, wherein said first and second gripping portions are comprised of rounded lobes.

14. A tool for installing or removing a first threaded member from a second threaded member, comprising:

an elongate, generally rectangular bridge having an upper surface and a lower surface a first end and a second end;

a jaw having an arcuate jaw body, said jaw being pivotally connected to said bridge by a pivot assembly, said pivot assembly comprising an elongate member extending through said upper and lower surfaces of said bridge and said jaw such that said jaw pivots in a circumferential direction around the long axis of said elongate member;

a cam rotatably connected to said bridge, distally spaced from said jaw, said cam having a laterally outwardly projecting camming surface; and a lever, operatively connected to said cam, movement of said lever in a first direction causing movement of said cam in a first direction which decreases the distance between said jaw and said camming surface, said bridge being disposed between said cam and said lever, said arcuate iaw body having a first lateral surface facing away from said cam and a second lateral surface facing toward said cam, said second lateral surface being concave.

15. The tool of claim 1, wherein said jaw and said cam are coplanar.

16. The tool of claim 15, wherein said jaw and said cam are both disposed beneath said bridge.

* * * * *